United States Patent [19]

Garth et al.

[11] 4,214,876

[45] Jul. 29, 1980

[54] CORROSION INHIBITOR COMPOSITIONS

[75] Inventors: Bruce H. Garth, Newark; Francis H. Schmidt, Wilmington, both of Del.

[73] Assignee: E. I. Du Pont de Nemours & Company, Wilmington, Del.

[21] Appl. No.: 968,850

[22] Filed: Dec. 12, 1978

Related U.S. Application Data

[63] Continuation-in-part of Ser. No. 657,583, Feb. 12, 1976, abandoned.

[51] Int. Cl.[2] ..... C10L 1/18

[52] U.S. Cl. ..... 44/66; 252/396

[58] Field of Search ..... 44/66; 252/396

[56] References Cited

U.S. PATENT DOCUMENTS 3,208,945 9/1965 Stuart et al. ..... 252/51.5

*Primary Examiner*—Winston A. Douglas
*Assistant Examiner*—Y. Harris-Smith
*Attorney, Agent, or Firm*—James A. Costello

[57] ABSTRACT

Improved corrosion inhibitor compositions for hydrocarbon fuels consisting of mixtures of (a) about 75 to 95 weight percent of a polymerized unsaturated aliphatic monocarboxylic acid having about 16 to 18 carbons, and (b) about 5 to 25 weight percent of a monoalkenylsuccinic acid wherein the alkenyl group has 8 to 18 carbons. Also described are concentrates of the above compositions in hydrocarbon solvents, as well as fuels containing the compositions.

12 Claims, 1 Drawing Figure

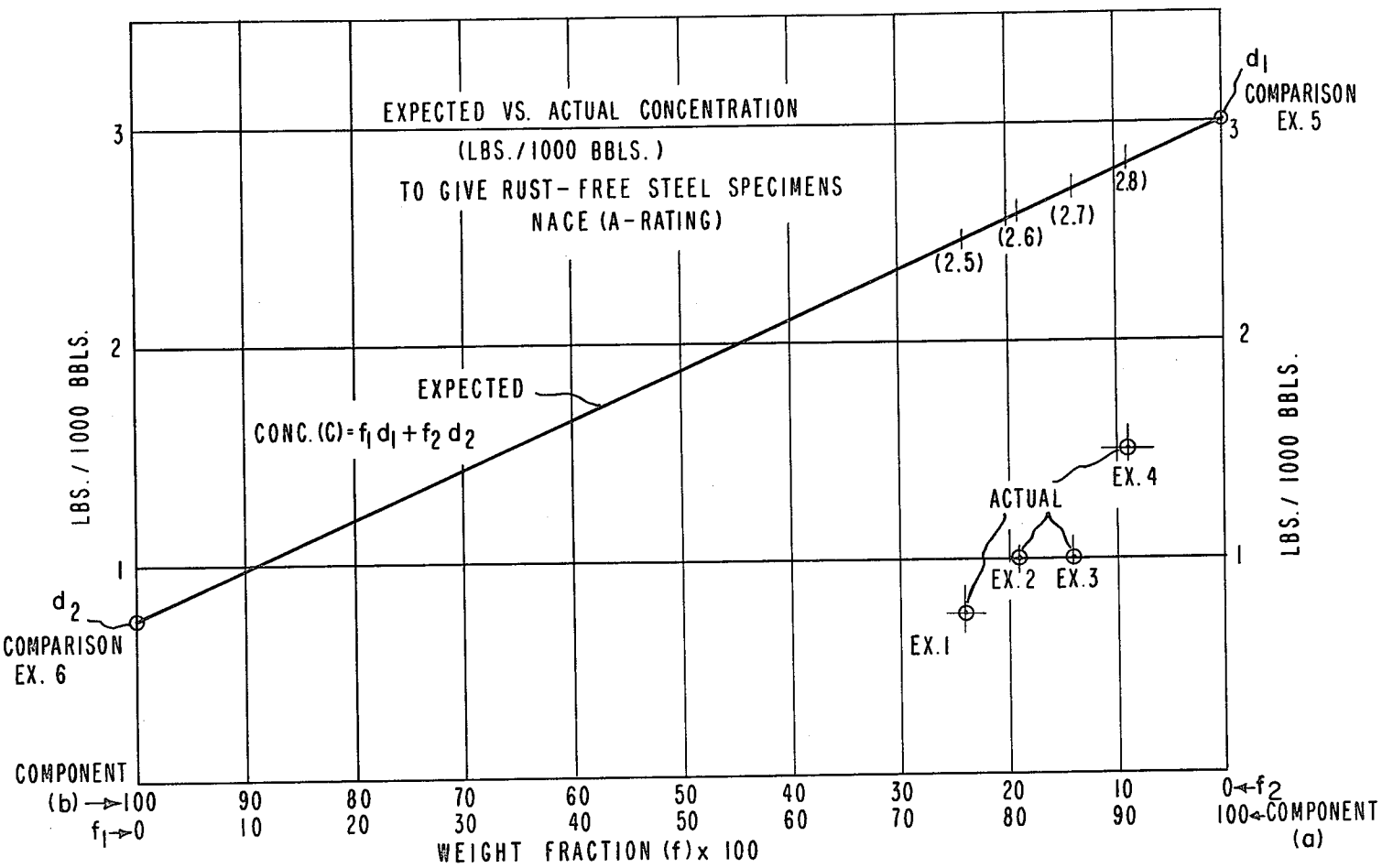
EXPECTED VS. ACTUAL CONCENTRATION
(LBS./1000 BBLS.)
TO GIVE RUST-FREE STEEL SPECIMENS
NACE (A-RATING)
EXPECTED
CONC.(C)=f1d1+f2d2
ACTUAL
EX.1
EX.2
EX.3
EX.4
(2.5)
(2.6)
(2.7)
(2.8)
d1 COMPARISON EX. 5
d2 COMPARISON EX. 6
LBS./1000 BBLS.
LBS./1000 BBLS.
3
2
1
COMPONENT (b) f1→0 ←100
WEIGHT FRACTION (f) x 100
0→f2 100→COMPONENT (a)
10 90
20 80
30 70
40 60
50 50
60 40
70 30
80 20
90 10

CORROSION INHIBITOR COMPOSITIONS

CROSS-REFERENCE TO RELATED APPLICATION

This is a continuation-in-part application of coassigned application bearing U.S. Ser. No. 657,583, filed Feb. 12, 1976, now abandoned.

BACKGROUND OF THE INVENTION

1. Field Of The Invention

This invention relates to novel corrosion inhibitors and to hydrocarbon solutions containing them.

2. Description Of The Prior Art

Corrosion inhibitors are often added to hydrocarbon liquids in an attempt to curb or prevent rusting of the systems in which the hydrocarbons are stored, the systems in which the hydrocarbons are used, or both. Two hydrocarbons to which corrosion inhibitors are usually added are fuels and lubricating oils. Different qualities may be sought in corrosion inhibitors intended for use in lubricating oils versus corrosion inhibitors intended for use in fuels. Furthermore, concentrations will vary widely, it being likely that concentrations of inhibitors in lubricating oils will be much higher than concentrations of inhibitors in fuels.

Corrosion inhibitors used in fuels are primarily intended to prevent corrosion in storage tanks and pipelines. The corrosion problem in storage and pipeline systems usually stems from water contamination. One of the requirements demanded of corrosion inhibitors intended for use in fuel systems is that the inhibitor must be effective in very small quantities. That demand is made to avoid any adverse effects such as adding to the gum component of the fuel, etc., as well as to minimize costs. Another important requirement is that the corrosion inhibitor, in the amounts employed, must not act to emulsify water.

There is presently a need for a corrosion inhibitor for use in fuel storage tanks and pipelines where temperatures generally parallel outdoor ambient temperatures, maximum temperatures only occasionally exceeding about 100° F. (38° C). The corrosion inhibitor should be effective at low concentrations and should not emulsify undesirable amounts of water. The two-component, acid/acid corrosion inhibitor of this invention satisfies that need.

U.S. Pat. No. 2,632,695 discloses the use of polymerized $C_{16\ to\ 18}$ unsaturated monocarboxylic acids as rust inhibitors for mineral oil products such as gasoline, naphthas and fuel oils. This patent also teaches that the performance of corrosion inhibitors depends upon whether the hydrocarbon substrate is a lubricating oil or a nonlubricating hydrocarbon fraction, such as a fuel. Patentees make it clear that the problem to be solved when the hydrocarbon is a fuel is different from the problem to be solved when the hydrocarbon is a lubricating fraction of mineral oil. See especially in that regard: Column 1, lines 8 to 25, column 2, lines 20 to 28, and column 14, line 41 to column 15, line 32.

U.S. Pat. No. 2,631,979 discloses the use of polymerized linoleic acid as a rust inhibitor for oils and fuels. U.S. Pat. Nos. 2,124,628 and 2,741,597 disclose the use of alkenylsuccinic acids as antirust agents in lubricating oils. U.S. Pat. No. 3,208,945 discloses a combination of a polymerized linoleic acid and a monoalkenylsuccinic anhydride having 8 to 18 carbon atoms in the alkenyl group as an antirust agent in lubricating oils.

Comparisons have been made between polymerized monocarboxylic acid/monoalkenylsuccinic anhydride compositions, and polymerized monocarboxylic acid/monoalkenylsuccinic acid compositions of this invention. The comparative results, shown by Examples 5 and 6 versus Comparative Examples 7 and 8 support patentability of the compositions of this invention because of their unexpectedly superior corrosion inhibiting properties.

SUMMARY OF THE INVENTION

The present invention concerns a corrosion inhibitor composition consisting essentially of, by weight, (a) about 75% to 95% of at least one polymerized unsaturated aliphatic monocarboxylic acid having about 16 to 18 carbon atoms per molecule, and (b) about 5% to 25% of a monoalkenylsuccinic acid in which the alkenyl group has 8 to 18 carbon atoms.

Preferred compositions contain from 80% to 90%, most preferably from 80% to 85% of the polymerized monocarboxylic acid component; and 10% to 20%, most preferably 15% to 20%, of the monoalkenylsuccinic acid component.

Also included in the invention is a concentrate consisting essentially of, by weight, (a) about 35% to 85% of the composition defined above, and (b) about 15% to 65% of a hydrocarbon solvent.

Also included is a hydrocarbon fuel containing an effective corrosion inhibiting amount of the defined composition.

BRIEF DESCRIPTION OF THE DRAWING

The FIGURE depicts, in one aspect, the expected activity of the two-component corrosion inhibitor of this invention based on the activity of each component separately. This depiction, embodied in the straight line, is supported by the data of Comparative Examples 5 and 6.

In contrast to the expected activity, is the actual (synergistic) activity shown by the plotting of data from Examples 1 to 4. The FIGURE shows that rust-free specimens are obtained at significantly lower concentrations of the two-component compositions of this invention than would be expected based on protection afforded by the individual components separately. Additional details concerning the synergistic activity of the compositions of this invention are provided in the text accompanying Examples 1 to 4 and Comparative Examples 1 to 6.

DETAILS OF THE INVENTION

Component (a)

The polymerized unsaturated aliphatic monocarboxylic acids contemplated to be employed herein are those prepared from the corresponding monocarboxylic acids by methods which are well known in the art. As will be appreciated by those skilled in the art, such polymerized acids generally contain 75% or more of dimer, trimer and higher polymerized acids and 25% or less of unpolymerized monocarboxylic acid.

For convenience, the "polymerized unsaturated aliphatic monocarboxylic acid having about 16 to 18 carbons" may be referred to as "Component (a)". It will be understood that the expression, "Component (a)", encompasses a mixture of monocarboxylic acid, dimer, trimer and higher polymerized acids as explained more fully heretofore and hereafter.

The products prepared by polymerization of unsaturated aliphatic monocarboxylic acids are sometimes referred to as "dimer acids" or "trimer acids" in the art. Such expressions are derived from the character of the major component of the polymerized product, i.e., dimer acids or trimer acids. The so-called dimer and trimer acids of the art are encompassed by the expression "Component (a)" employed herein. The term "dimer acid" may be employed hereafter to refer to "Component (a)" acid in which the dimer acid is the major constituent.

Descriptions of the preparation and properties of dimer and trimer acids can be found in the Journal of the American Oil Chemists' Society 24, 65 to 68 (1947); and in U.S. Pat. Nos. 2,482,761; 2,631,979; 2,632,695; and 2,794,782. As shown in the art, dimer acids can be prepared by heating under pressure an unsaturated fatty acid in the presence of a small amount of water at a temperature of 260° to 360° C. for 3 to 8 hours. The dimer acid thus produced usually also contains some unpolymerized monocarboxylic acid, some trimer acid and some higher polymerized acids. If desired, the amount of the trimer acids can be increased by varying the reaction conditions.

Commercially available dimer acids include "Empol" Dimer Acids (Emery Industries). They are prepared by polymerizing linoleic acids, and contain from 40% to 95% of dimer acids and from 4% to 25% of trimer acids. Commercial trimer acids include "Empol" Trimer Acids which contain from 40% to 95% of trimer acids and from 5% to 25% of dimer acids. Both types of compositions can contain up to 25% of monocarboxylic acids.

Because of their availability and low cost, mixtures of fatty acids called "tall oil fatty acids" are often used to produce dimer and trimer acid compositions. Polymerized tall oil fatty acids, such as "Acintol" FA-7002 (Arizona Chemical Company) can be used to prepare the compositions of this invention. A typical analysis of "Acintol" FA-7002 (in weight percentages) is as follows:

| | |
|---|---|
| Acid Value | 143 |
| Rosin Acid, % | 13 |
| Unsaponifiables, % | 3 |
| Monomers, % | 18 |
| Dimers, % | 66 |
| High Polymers, % | 16 |

Component (b)

The contemplated monoalkenylsuccinic acids are well known in the art. These acids are readily prepared by the condensation of an olefin with maleic anhydride followed by hydrolysis (see U.S. Pat. No. 2,133,734 and 2,741,597). Suitable monoalkenylsuccinic acids include octenylsuccinic acid, decenylsuccinic acid, undecenylsuccinic acid, dodecenylsuccinic acid, pentadecenylsuccinic acid, octadecenylsuccinic acid and isomers thereof having alkenyl groups of various hydrocarbon structures. The preferred monoalkenylsuccinic acid is dodecenylsuccinic acid, more preferably dodecenylsuccinic acid prepared from propylene tetramer.

The hydrocarbon fuels into which the compositions of this invention are incorporated to provide corrosion inhibiting characteristics are normally liquid hydrocarbon fuels boiling in the range of about 20° C. to 375° C. and include motor gasolines, aviation gasolines, jet fuels, kerosenes, diesel fuels, and fuel oils. The hydrocarbon fuel compositions containing the compositions of this invention as corrosion inhibitors may also contain conventional additives such as antiknock compounds, antioxidants, metal deactivators, other corrosion inhibitors, antistatic agents, antiicing agents, detergents, dispersants, thermal stabilizers, dyes and the like.

The compositions of the invention incorporated into hydrocarbon fuels in the range of about 0.0002 to 0.002 percent by weight (0.5 to 5 pounds per thousand barrels, ptb) provide satisfactory corrosion-inhibiting properties. Concentrations higher than about 0.002% can be used but do not appear to provide further benefits. The preferred concentration range is about 0.0003 to 0.0016 percent by weight (0.75 to 4 ptb), the more preferred range is about 0.0004 to 0.0012 percent by weight (1 to 3 ptb).

The corrosion-inhibitor compositions of the invention can be added to the hydrocarbon fuels by any means known in the art for incorporating small quantities of additives into hydrocarbon fuels. Components (a) and (b) can be added separately or they can be combined and added together. It is convenient to utilize the present compositions as concentrates, that is, as concentrated solutions in suitable solvents. When used as a concentrate, the additive composition will contain about 35% to 85%, by weight, of a combination of Component (a) and Component (b) and about 65% to 15% by weight of a solvent. The preferred concentrate will have about 60% to 80% by weight of the combination and about 20% to 40% by weight of solvent. The most preferred concentrate will have about 65% to 75%, by weight, of Components (a) and (b) and about 25% to 35% of solvent.

Suitable solvents are normally liquid organic compounds boiling in the hydrocarbon fuel boiling range, particularly hydrocarbons and alcohols, and include hexane, cyclohexane, heptane, octane, isooctane, benzene, toluene, xylene, methanol, ethanol, propanol, butanol, gasolines, jet fuels, fuel oils and the like. Mixtures of solvents can also be used. The preferred solvent is xylene.

The following Examples illustrate the invention.

EXAMPLES 1 to 4 AND COMPARATIVE EXAMPLES 1 TO 6

Antirust Evaluation vs. Acid/Anhydride Combination

Antirust performances of the compositions of this invention were determined according to NACE (National Association of Corrosion Engineers) Standard TM-01-72, "Antirust Properties of Petroleum Products Pipeline Cargoes". The test method is essentially the ASTM D665 method modified to determine antirust properties of gasolines and distillate fuels in movement through product pipelines. The method involves stirring a mixture of the test fuel and distilled water for 4 hours at 38° C. with a cylindrical steel specimen immersed in the mixture. The antirust rating is based on the portion of the test specimen exposed within the test fluid and is expressed using the following rating scale:

| Rating | Proportion of Test Surface Rusted |
|---|---|
| A | None |
| B++ | Less than 0.1% (2 or 3 spots of no more than 1 mm diameter) |
| B+ | Less than 5% |
| B | 5 to 25% |
| C | 25 t0 50% |
| D | 50 to 75% |
| E | 75 to 100% |

Ordinarily a rating of $B^{30}$ or B++ is adequate to control corrosion in active pipeline, although a rating of A is obviously more desirable.

The polymerized monocarboxylic acid, "Acintol" FA-7002, Arizona Chemical Co., described more fully above, was combined with dodecenylsuccinic acid in the weight ratios indicated in Table I and dissolved in xylene to provide concentrates containing 79% by weight of the combination. The concentrates were added to depolarized isooctane in the concentrations indicated. The tests were run in duplicate.

For comparison purposes, similar concentrates were prepared using dodecenylsuccinic anhydride instead of the dodecenylsuccinic acid and similarly tested. The results are summarized in Table I.

It is clear from Examples 1 to 4 that the corrosion inhibitors of this invention provide effective rust protection at very low concentrations. The results also show that the corrosion inhibitors of this invention are markedly superior to similar combinations employing dodecenylsuccinic anhydride in place of dodecenylsuccinic acid. Thus, at an 81/19 ratio (Example 2 and Comparison Example 2), twice as much of the Component (a)—dodecenylsuccinic anhydride as Component (a)—Dodecenylsuccinic acid is required to obtain an A rating. Similarly, at 86/14 and 91/9 ratios (Examples 3 and 4, Comparison Examples 3 and 4), the combinations containing the dodecenylsuccinic acid are greatly superior, per unit concentration, to the combinations containing the anhydride.

TABLE I

| | | | NACE RUST TESTS | | | | | |
|---|---|---|---|---|---|---|---|---|
| | | | Concentration, lb/1000 bbl | | | | | |
| | Wt. Ratio[1] | Dodecenyl-succinic | 0.5 (0.00016)[2] | 0.75 (0.00024)[2] | 1.0 (0.00032)[2] | 1.5 (0.00048)[2] | 2.0 (0.00064)[2] | 3.0 (0.00096)[2] |
| Example 1 | 76/24 | Acid | B+B+ | AA | — | — | — | — |
| Comp. Ex. 1 | 76/24 | Anhydride | B+B+ | AA | — | — | — | — |
| Example 2 | 81/19 | Acid | — | — | AA | — | — | — |
| Comp. Ex. 2 | 81/19 | Anhydride | — | — | B+B | B+B | AA | — |
| Example 3 | 86/14 | Acid | — | — | AA | — | — | — |
| Comp. Ex. 3 | 86/14 | Anhydride | — | — | BB | B+B++ | B++B++ | — |
| Example 4 | 91/9 | Acid | — | — | BB | AA | — | — |
| Comp. Ex. 4 | 91/9 | Anhydride | — | — | BB+ | B+B+ | — | — |
| Comp. Ex. 5 | 100/0 | — | — | — | CC | BB | BB | AA |
| Comp. Ex. 6 | 0/100 | Acid | B+B+ | AA | — | — | — | — |

[1]Weight ratio: $\frac{\text{Polymerized Monocarboxylic Acid}}{\text{Dodecenylsuccinic Acid}}$ (of the invention); or $\frac{\text{Polymerized Monocarboxylic Acid}}{\text{Dodecenylsuccinic Anhydride}}$ (of the art)

[2]Weight percent, active ingredients in isooctane

Since the only difference between the Example compositions and the Comparison Example compositions is that the Example compositions have dodecenylsuccinic acid in combination with Component (a) whereas in the Comparison Example compositions dodecenylsuccinic anhydride is used, the data clearly demonstrate nonequivalency of dodecenylsuccinic acid and dodecenylsuccinic anhydride in the present application.

The Combination Of Components (a) and (b) is Synergistic

The results also show that the inhibitors of this invention inhibit rusting to a greater extent than would be expected considering the expected contribution of each component of the combination. Based on the concentrations of Component (a) (Comparison Example 5) and of Component (b) (Comparison Example 6) needed to provide a rust-free specimen (A rating), the fuel concentration of any particular mixture of the two which would be expected to provide rust-free specimens can be readily determined.

For example, in a mixture of dimer acid and dodecenylsuccinic acid of weight ratio 81/19, respectively, the minimum fuel concentration of the mixture which would be expected to provide a rust-free A rating on an additive effect basis is given by the linear expression $$C=f_1d_1+f_2d_2$$

where $f_1$ is the weight fraction of dimer acid in the combination (0.81), $d_1$ is the concentration of dimer acid required for an "A" rating (3 lb/1000 bbl, Comp. Ex. 5), $f_2$ is the weight fraction of dodecenylsuccinic acid in the combination (0.19), and $d_2$ is the concentration of dodecenylsuccinic acid required for an "A" rating (0.75 lb/1000 bbl. Comp. Ex. 6).

Thus, for a 81/19 combination of dimer acid and dodecenylsuccinic acid, the minimum fuel concentration required for a rust-free "A" rating would be $f_1d_1+f_2d_2=(0.81)(3.0)+(0.19)(0.75)=2.6$ lb/1000 bbl. Similar calculations can be made for other weight ratios.

Minimum concentrations of other corrosion inhibitor combinations of the invention which would be expected to provide rust-free specimens can also be determined graphically as illustrated in FIG. 1. In FIG. 1, the left origin of the straight line represents the concentration of dodecenylsuccinic acid required to provide a rust-free specimen ($d_2$, 0.75 lb/1000 bbl. Comp. Ex. 6) while the right terminus of the straight line represents the concentration of dimer acid required to provide a rust-free specimen ($d_1$, 3.0 lb/1000 bbl. Comp. Ex. 5) and the abscissa represents weight fractions ($f_1$, $f_2$) of the components in the combination. The straight line joining these two points represents the minimum concentration of combinations of dimer acid and dodecenylsuccinic acid for various weight fractions of the two components which would be expected to provide rust-free specimens.

The data in parentheses along the line represent concentrations of the compositions described in Examples 1 to 4, i.e., weight ratios of dimer acid/dodecenylsuccinic acid of 76/24; 81/19; 86/14 and 91/9 which would be expected to provide rust-free specimens. These values are also given in column 3 of Table II. The fuel concentrations actually found to provide rust-free specimens for the above weight ratios (Table II, column 4) are indicated in FIG. 1 by circles, far below the expected concentration line.

Table II compares the fuel concentrations of the combinations expected to provide rust-free specimens to the concentrations actually found necessary to provide such protection in the NACE test.

TABLE II

| Example | Ratio[2] | Concentration[1] (lb/1000 bbl) for Rust-free Specimen | |
|---|---|---|---|
| | | Expected | Found |
| 1 | 76/24 | 2.5 | 0.75 |
| 2 | 81/19 | 2.6 | 1.0 |
| 3 | 86/14 | 2.7 | 1.0 |
| 4 | 91/9 | 2.8 | 1.5 |

[1]79 weight percent solution of the inhibitor of this invention in xylene

[2]Wt. ratio: $\frac{\text{Polymerized Monocarboxylic Acid}}{\text{Dodecenylsuccinic Acid}}$ From Table II it can be seen that the compositions of this invention are significantly more efficient corrosion inhibitors than expected.

Example 5 And Comparison Example 7

Antirust performance of a composition of this invention as well as that of a comparison composition wherein dodecenylsuccinic anhydride was used in place of dodecenylsuccinic acid were also determined in a gasoline having the following specification:

| | |
|---|---|
| ASTM D-86 Distillation | °C. |
| Initial Boiling Point | 37 |
| 5% | 53 |
| 10% | 61 |
| 20% | 76 |
| 30% | 89 |
| 40% | 103 |
| 50% | 117 |
| 60% | 131 |
| 70% | 146 |
| 80% | 160 |
| 90% | 184 |
| 95% | 199 |
| End Point | 217 |
| Recovery % | 98.0 |
| Residue % | 1.0 |
| Loss % | 1.0 |
| ASTM D-323 Reid Vapor Pressure (lbs) | 6.7 |
| ASTM D-525 Induction Period (mins) | 1220 |
| Lead (AA gms Pb/gal) | 3.36 |
| Gum | |
| Existing (mg/100 ml) (washed and unwashed) ASTM D-381 | |
| ASTM D-1319 Hydrocarbon Types | |
| Saturates Vol. % | 60 |
| Olefins Vol. % | 12 |
| Aromatics Vol. % | 28 |

The test was carried out according to the previously described NACE TM-01-72 procedure and the results (averages of the indicated number of runs) are summarized in Table III.

The composition of the invention used in the test contained 56.7 weight percent of Component (a) described in Example 1, 13.3 weight percent of dodecenylsuccinic acid and 30.0 weight percent of xylene. The comparison composition contained 56.7 weight percent of the same Component (a) acid, 13.3 weight percent of dodecenylsuccinic anhydride and 30.0 weight percent of xylene. The weight ratio of Component (a) to dodecenylsuccinic acid (or dodecenylsuccinic anhydride) is 81/19 and the only difference between the composition of this invention and the comparison composition is that in the comparison composition dodecenylsuccinic anhydride is used in place of dodecenylsuccinic acid.

TABLE III

| Inhibitor Composition | NACE RUST TESTS | | |
|---|---|---|---|
| | Conc. lb/1000 bbl | % Rust on Specimen | NACE Rating |
| Control (Gasoline only) | | | |
| Average of 4 | — | 75 | D |
| Example 5 | | | |
| Average of 2 | 0.5 | 1 | B+ |
| Average of 2 | 0.75 | 0 | A |
| Average of 2 | 1.0 | 0 | A |
| Comparison Example 7 | | | |
| Average of 2 | 1.0 | 20 | B |
| Average of 2 | 1.5 | 7 | B |
| Average of 2 | 2.0 | 4 | B+ |
| Average of 2 | 3.0 | 8 | B |

The above results clearly demonstrate that the compositions of this invention are effective corrosion inhibitors at very low concentrations. The results also demonstrate a significant and unexpected difference in efficiency between a composition of this invention and one differing only in containing dodecenylsuccinic anhydride in place of dodecenylsuccinic acid. Thus, under identical test conditions, the composition of this invention provides a rust-free specimen (A rating) at 0.75 pounds per thousand barrels in the gasoline used whereas the composition of Comparison Example 7 is not capable of providing a rust-free specimen even at 3 pounds per thousand barrels.

Example 6 And Comparative Examples 7 and 8

This Example demonstrates the property of the composition of this invention to continue to protect a metal surface from rusting after an initial exposure to the composition. In this test, the cylindrical steel specimens were first rated for rusting by exposure to gasoline containing inhibitor compositions for 4 hours according to the standard NACE TM-01-72 procedure. The steel specimens were then immersed in a stirred mixture of gasoline and water without the presence of any corrosion inhibitor and the progressive rusting of the steel specimen was determined at the time intervals indicated. The gasoline used was that described in Example 5.

The initial part of the test was carried out using the inhibitor compositions of Example 5, a comparison composition of Example 7 and a comparison composition of Example 8. The composition of Comparison Example 8 contained 56.7 weight percent of dimer acid and 43.3 weight percent of xylene. The difference in the compositions tested is that the composition of Example 5 has dodecenylsuccinic acid in combination with dimer acid; the composition of Comparative Example 7 has dodecenylsuccinic anhydride in combination with the dimer acid; and the composition of Comparative Example 8 has dimer acid only.

The results of the initial exposure are summarized in Table IV. It will be noted that in this gasoline, the addition of dodecenylsuccinic anhydride to dimer acid had no effect in enhancing the antirust property of the dimer acid alone (compare numbers 3 and 4).

TABLE IV

| NACE RUST TESTS | | | |
|---|---|---|---|
| Steel Specimen Exposed to Gasoline Containing- | Conc. (lb/1000 bbl) | % Rust | NACE Rating |
| 1. No inhibitor | — | 70 | D |
| 1(a). No inhibitor | — | 70 | D |
| 2. Composition of Example 5 (dimer acid/succinic acid) | 0.75 | 0 | A |
| 2(a). Composition of Example 5 | 0.75 | 1 | B+ |
| 2(b). Composition of Example 5 | 0.75 | 0 | A |
| 2(c). Composition of Example 5 | 0.75 | 0 | A |
| 3. Composition of Comparative Example 7 (dimer acid/succinic anhydride | 0.75 | 65 | D |
| 3(a). Composition of Comparative Example 7 | 0.75 | 70 | D |
| 4. Composition of Comparative Example 8 (dimer acid only) | 0.75 | 65 | D |
| 4(a). Composition of Comparative Example 8 | 0.75 | 65 | D |

The tests were then continued by immersing the steel specimens, after rating, in a gasoline-distilled water mixture (300 ml of gasoline and 30 ml of water). At the indicated time intervals, the steel specimens were taken out of the gasoline/water mixture and the percent rust was determined, after which the steel specimens were returned to the gasoline/water mixture. The results, which indicate Film Persistency or the desorption rate of the inhibitor from the surface of the steel specimens, are summarized in Table V.

TABLE V

| FILM PERSISTENCY TESTS<br>Steel Specimens in Gasoline/Water (300 ml/30 ml)<br>No Corrosion Inhibitor | | | | | | | |
|---|---|---|---|---|---|---|---|
| Steel Specimen Initially Exposed to Gasoline Containing- | Time Intervals | 15 Min | | 45 Min | | 18 Hrs | |
| | | % Rust | NACE Rating | % Rust | NACE Rating | % Rust | NACE Rating |
| 1. No inhibitor | | 80 | E | 80 | E | 98 | E |
| 1(a). No inhibitor | | 80 | E | 80 | E | 98 | E |
| 2(a). Ex. 5 Composition | | 1 | B+ | 1 | B+ | 35 | C |
| 2(b). Ex. 5 Composition | | >0.1 | B++ | 0.5 | B+ | 15 | B |
| 2(c). Ex. 5 Composition | | 0 | A | 0 | A | 7 | B |
| 3(a). Comp. Ex. 7 Composition | | 70 | D | 70 | D | 85 | E |
| 4(a). Comp. Ex. 8 Composition | | 65 | D | 70 | D | 85 | E |

The results summarized in Table V show that metals exposed to fuel containing the corrosion inhibitor of the invention retain their antirust protection for a considerable length of time even when the metals are subsequently exposed to fuel which does not contain any corrosion inhibitor. The results also demonstrate that the retention of antirust protection is considerably superior with the composition of the invention than with the composition containing the anhydride in place of the acid or that containing dimer acid alone.

The practical significance of these results with respect to hydrocarbon fuel transport in pipelines is that the compositions of this invention provide instantaneous rust protection as well as long term persistent antirust protection of the interior surfaces of the pipelines, etc., even should the fuel following the corrosion inhibited fuel not contain any corrosion inhibitor.

Example 7 And Comparative Examples A to G

A representative corrosion inhibitor of the present invention was compared in efficiency with several commercial corrosion inhibitors qualified under MIL-1-25017-10 specifications. Qualified corrosion inhibitors are those acceptable to the military for use in automotive gasolines, aviation gasolines and turbine fuels. The corrosion tests were carried out by the NACE Standard TM-01-72 procedure as described in the previous Examples.

The combination of Example 3 was used as a 79% solution in xylene. The commercial corrosion inhibitors were used as purchased. The results, obtained in motor gasoline, are summarized in Table VI.

TABLE VI

| CORROSION INHIBITORS - COMPARATIVE EFFICIENCIES | | | | | | | | | |
|---|---|---|---|---|---|---|---|---|---|
| | Pounds/1000 bbls. | | | | | | | | |
| Additive | 0 | 0.75 | 1.0 | 1.5 | 2.0 | 3.0 | 4.0 | 5.0 | 6.0 |
| None | EE | — | — | — | — | — | — | — | — |
| Example 7 (Comp. of Ex. 3) | — | B+B+ | AA | — | — | — | — | — | — |
| Comp. Exp. A | — | — | BD | AA | — | — | — | — | — |
| Comp. Exp. B | — | — | — | — | B+B+ | AA | — | — | — |
| Comp. Exp. C | — | — | — | — | — | — | — | B+B+ | AA |
| Comp. Exp. D | — | — | — | — | — | — | — | BB | AA |
| Comp. Exp. E | — | — | — | — | — | — | B+B+ | AA | — |

TABLE VI-continued

| CORROSION INHIBITORS - COMPARATIVE EFFICIENCIES | | | | | | | | | |
|---|---|---|---|---|---|---|---|---|---|
| | Pounds/1000 bbls. | | | | | | | | |
| Additive | 0 | 0.75 | 1.0 | 1.5 | 2.0 | 3.0 | 4.0 | 5.0 | 6.0 |
| Comp. Exp. F | — | — | — | — | B+B+ | AA | — | — | — |
| Comp. Exp. G | — | — | — | — | — | BB | AA | — | — |

The data of Table VI show that the compositions of this invention, in being useable at lower concentrations, provide a higher degree of rust protection efficiency than any of the commercial corrosion inhibitors tested.

Example 8

Water Separation Index, Modified (WSIM), which is a numerical rating indicating the ease of separating water from fuel by coalescence was determined by the ASTM D 2550 Method, "Water Separation Characteristics of Aviation Turbine Fuels", carried out by minisonic (MSS) modification. The method involves preparation of a water-fuel emulsion, metering the emulsion through a glass fiber coalescer, and photometrically measuring the turbidity due to entrained water. The WSIM rating is from 0 to 100 with the higher number indicating greater ease of water separation. Ordinarily, an acceptable additive for turbine fuels should have a WSIM rating of not less than 70 in use concentrations. WSIM ratings of several compositions of this invention in JP-4 Jet Fuel are summarized in Table VII.

TABLE VII

| WATER SEPERATION INDEX. MODIFIED | | | | |
|---|---|---|---|---|
| | | Concentration | | WSIM |
| Inhibitor | Wt. Ratio[1] | Lb/1000 bbl | Wt. % | Rating |
| None | — | — | — | 94 |
| of Ex. 1 | 76/24 | 0.75 | 0.0003 | 90 |
| of Ex. 1 | 76/24 | 1.0 | 0.0004 | 88 |
| of Ex. 2 | 81/19 | 1.0 | 0.0004 | 94 |

[1]Wt Ratio: $\frac{\text{Polymerized Monocarboxylic Acid}}{\text{Dodecenylsuccinic Acid}}$ These results show that the compositions of this invention do not interfere with the separation of water from fuel at concentrations which give excellent antirust activity (Table I).

The embodiments of the invention in which an exclusive property or privilege is claimed are defined as follows:

1. A corrosion inhibitor composition for hydrocarbon fuels consisting essentially of, by weight, (a) about 75% to 95% of at least one polymerized unsaturated aliphatic monocarboxylic acid, said unsaturated acid having 16 to 18 carbons per molecule, and (b) about 5% to 25% of at least one monoalkenylsuccinic acid in which the alkenyl group has 8 to 18 carbons.

2. The composition of claim 1 in which the polymerized unsaturated aliphatic monocarboxylic acid is polymerized tall oil fatty acid.

3. The composition of claim 1 in which the polymerized unsaturated aliphatic monocarboxylic acid is linoleic acid.

4. The composition of claim 1 in which the monoalkenylsuccinic acid is dodecenylsuccinic acid.

5. A corrosion inhibitor compositiion of claim 1 consisting essentially of (a) a polymerized tall oil fatty acid, and (b) dodecenylsuccinic acid.

6. A composition of claim 1 wherein (a) is about 80% to 90% and (b) is about 10% to 20%.

7. A composition of claim 6 wherein (a) is about 80% to 85% and (b) is about 15% to 20%.

8. A corrosion inhibitor concentrate comprising about 35% to 85% by weight of a composition of claim 1 in at least one normally liquid member of the group consisting of hydrocarbons and alcohols.

9. A concentrate of claim 8 wherein the polymerized unsaturated aliphatic monocarboxylic acid is a polymerized tall oil fatty acid.

10. A concentrate of claim 8 wherein the polymerized unsaturated aliphatic monocarboxylic acid is polymerized linoleic acid.

11. A concentrate of claim 8 wherein the monoalkenylsuccinic acid is dodecenylsuccinic acid.

12. A concentrate of claim 9 wherein the monoalkenylsuccinic acid is dodecenylsuccinic acid.

* * * * *